US012391441B2

(12) United States Patent
Prymula et al.

(10) Patent No.: US 12,391,441 B2
(45) Date of Patent: Aug. 19, 2025

(54) PRESSURE RELIEF ASSEMBLIES AND METHODS

(71) Applicant: ILLINOIS TOOL WORKS INC., Glenview, IL (US)

(72) Inventors: David Prymula, Glenview, IL (US); Bret Shankleton, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 135 days.

(21) Appl. No.: 17/927,226

(22) PCT Filed: May 10, 2021

(86) PCT No.: PCT/US2021/031559

§ 371 (c)(1),
(2) Date: Nov. 22, 2022

(87) PCT Pub. No.: WO2022/240388

PCT Pub. Date: Nov. 17, 2022

(65) Prior Publication Data

US 2023/0219725 A1 Jul. 13, 2023

(51) Int. Cl.
*B65D 51/16* (2006.01)
*B65D 83/70* (2006.01)

(52) U.S. Cl.
CPC ..... *B65D 51/1638* (2013.01); *B65D 83/70* (2013.01)

(58) Field of Classification Search
CPC ..... B65D 51/1638; B65D 83/70; B05B 15/14
USPC ..... 220/203.08
See application file for complete search history.

(56) References Cited

U.S. PATENT DOCUMENTS

| | | | | |
|---|---|---|---|---|
| 3,815,534 | A * | 6/1974 | Kneusel | F17C 13/123 220/624 |
| 3,880,316 | A * | 4/1975 | Martella | B65D 17/401 220/276 |
| 4,003,505 | A | 1/1977 | Hardt | |
| 4,126,244 | A * | 11/1978 | Elser | B65D 17/404 215/253 |
| 4,803,136 | A | 2/1989 | Bowsky | |
| 7,222,757 | B2 | 5/2007 | Ferreira | |
| 2005/0051554 | A1* | 3/2005 | Cook | B65D 79/0087 220/293 |
| 2013/0020320 | A1 | 1/2013 | Ferreira | |
| 2019/0296272 | A1* | 9/2019 | Lee | H01M 50/176 |
| 2021/0175577 | A1* | 6/2021 | Shiotani | H01M 50/3425 |

FOREIGN PATENT DOCUMENTS

CN 106115089 A 11/2016

OTHER PUBLICATIONS

International Search Report and Written Opinion for PCT/US2021/031559, dated Feb. 22, 2022 (14 pages).

* cited by examiner

*Primary Examiner* — James N Smalley
(74) *Attorney, Agent, or Firm* — Quarles & Brady LLP

(57) ABSTRACT

A closure 20 for a pressurized container having a plate with a top side 24 and a bottom side 28, a first notch 22 that extends about a first axis A1 along the top side, and a second notch 26 that extends about the first axis along the bottom side. The first and second notch form a membrane 62 that is capable of being ruptured when a maximum pressure causes the membrane to rupture.

19 Claims, 8 Drawing Sheets

PRESSURE RELIEF ASSEMBLIES AND METHODS

CROSS REFERENCE TO RELATED APPLICATIONS

The present application represents the United States National Stage of International Application No. PCT/US2021/031559, filed May 10, 2021, the entire contents of which are incorporated by reference in its entirety.

FIELD OF EMBODIMENTS OF THE DISCLOSURE

The present disclosure relates to closures with one or more pressure relief features, and more specifically, to closures that include one or more pressure relief features for pressurized containers.

BACKGROUND

Various types of containers or canisters are utilized to retain or hold contents that may be initially pressurized, or may become pressurized over time. For example, aerosol canisters may be pressurized with an aerosol, and may retain this initial pressurization until a user causes aerosol to be released, thereby reducing the pressure within the aerosol canister. In some instances, a container may be pressurized, and may maintain the initial level of pressurization throughout the life cycle of the contents of the container. In still other instances, a container may become pressurized over time due to one or more factors that cause the container to become pressurized, such as a chemical reaction that occurs within the container.

In any of the aforementioned pressurization situations, one or more features may be built into or along one or more portions of the container, which may allow for venting of the container in the event that venting becomes necessary. In the scenario where pressure within the container increases after the container has been initially sealed, a venting feature may be included to prevent over-pressurization of the container, which could result in an uncontrolled release of contents from within the container.

While various venting features exist that provide for venting or depressurization of containers that include contents that become pressurized over time, improved devices and methods are needed that can allow for more controlled depressurization based on pre-determined factors associated with the contents of a particular container.

SUMMARY

Embodiments of the present disclosure generally relate to a closure for a pressurized container that includes a plate with a top side and a bottom side, a first notch that extends about a first axis along the top side, and a second notch that extends about the first axis along the bottom side. The first and second notch form a membrane that is capable of being ruptured when a maximum pressure causes the membrane to rupture.

In another aspect, a closure for a pressurized container includes a plate with a top side and a bottom side, and a first notch that extends about a first axis along the top side. The first notch defines an inner surface, an outer surface, and a bottom surface. The inner surface defines a first plane that is tangent to a first point along the inner surface and the outer surface defines a second plane that is tangent to a second point along the outer surface. A line between the first point and the second point is orthogonal with respect to the first axis. The first plane and the second plane intersect to define a first angle of between 61.000 degrees and 180.000 degrees.

In still another aspect, a closure for a pressurized container includes a plate defining a top side, a bottom side, and a first diameter across the top side. The plate further includes a first notch that extends about a first axis along the top side, the first notch defining a second diameter, and a second notch that extends about the first axis along the bottom side. A ratio of the second diameter to the first diameter is between 0.700 and about 0.990.

Other aspects of the closure described herein, including features and advantages thereof, will become apparent to one of ordinary skill in the art upon examination of the figures and detailed description herein. Therefore, all such aspects of the closure are intended to be included in the detailed description and this summary.

DETAILED DESCRIPTION

Figure 1:
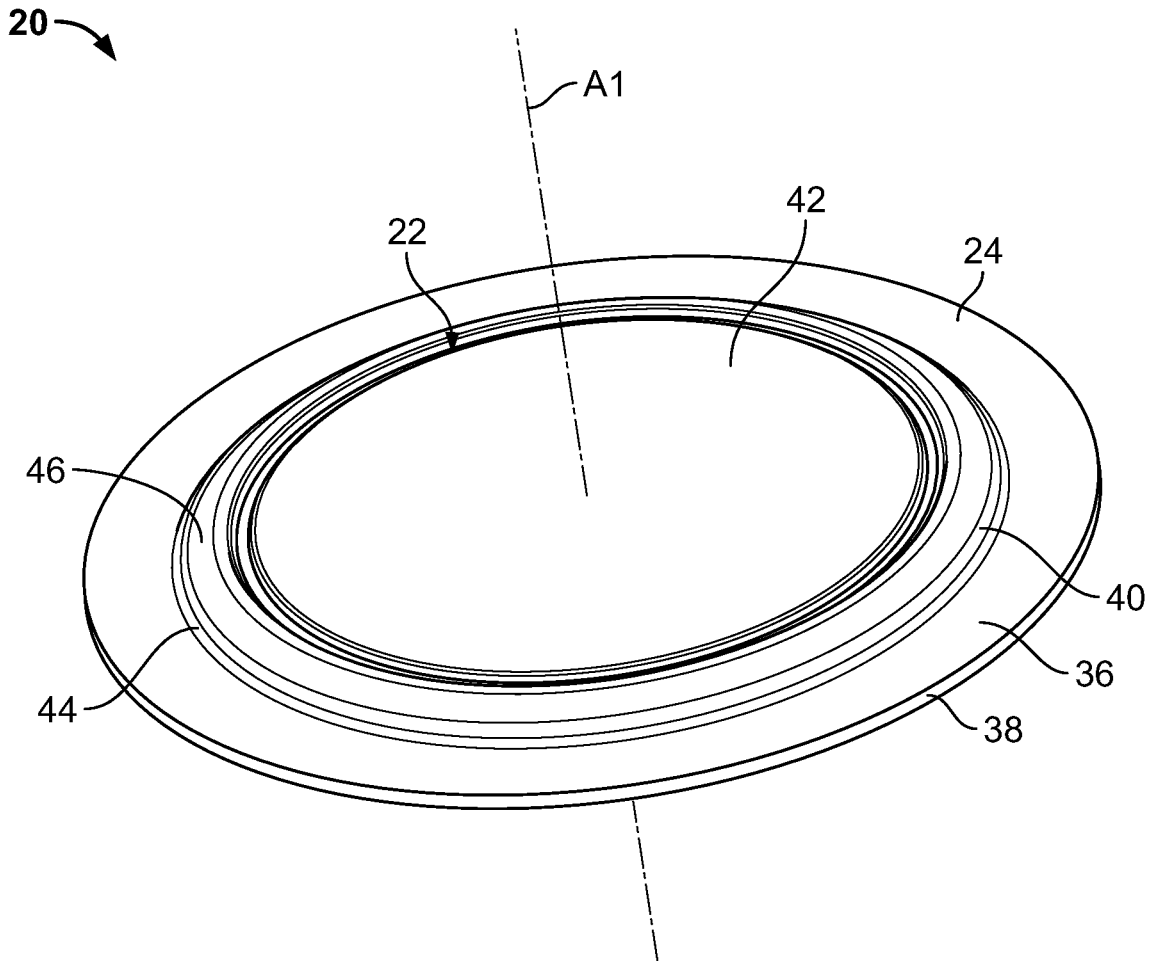
FIG. 1 is a top isometric view of a lid with first and second pressure relief features, as disclosed herein.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Throughout the disclosure, the terms "about" and "approximately" mean plus or minus 5% of the number that each term precedes.

Embodiments of the present disclosure provide for a closure, plate, or lid that may be coupled with a canister or container, the closure having one or more pressure relief or venting features that allow for depressurization within the canister or container, if depressurization is needed. The venting features described herein may be formed along opposing sides of the closure, and may be disposed along various portions of the closure. The venting features of the present disclosure may be implemented in a wide variety of technologies, including applications related to aerosol containers, battery cell containers, capacitors, and pressure vessels. In each of the aforementioned applications, pressure release may be required due to pressure build-up within the container, and the venting features disclosed herein may allow for depressurization once a maximum pressure threshold has been reached. While additional pressure relief features may be included in combination with any of the devices contemplated herein to which the lid with pressure relief features may be coupled, the pressure relief features disclosed herein may be utilized on their own as standalone pressure relief features.

Figure 2:
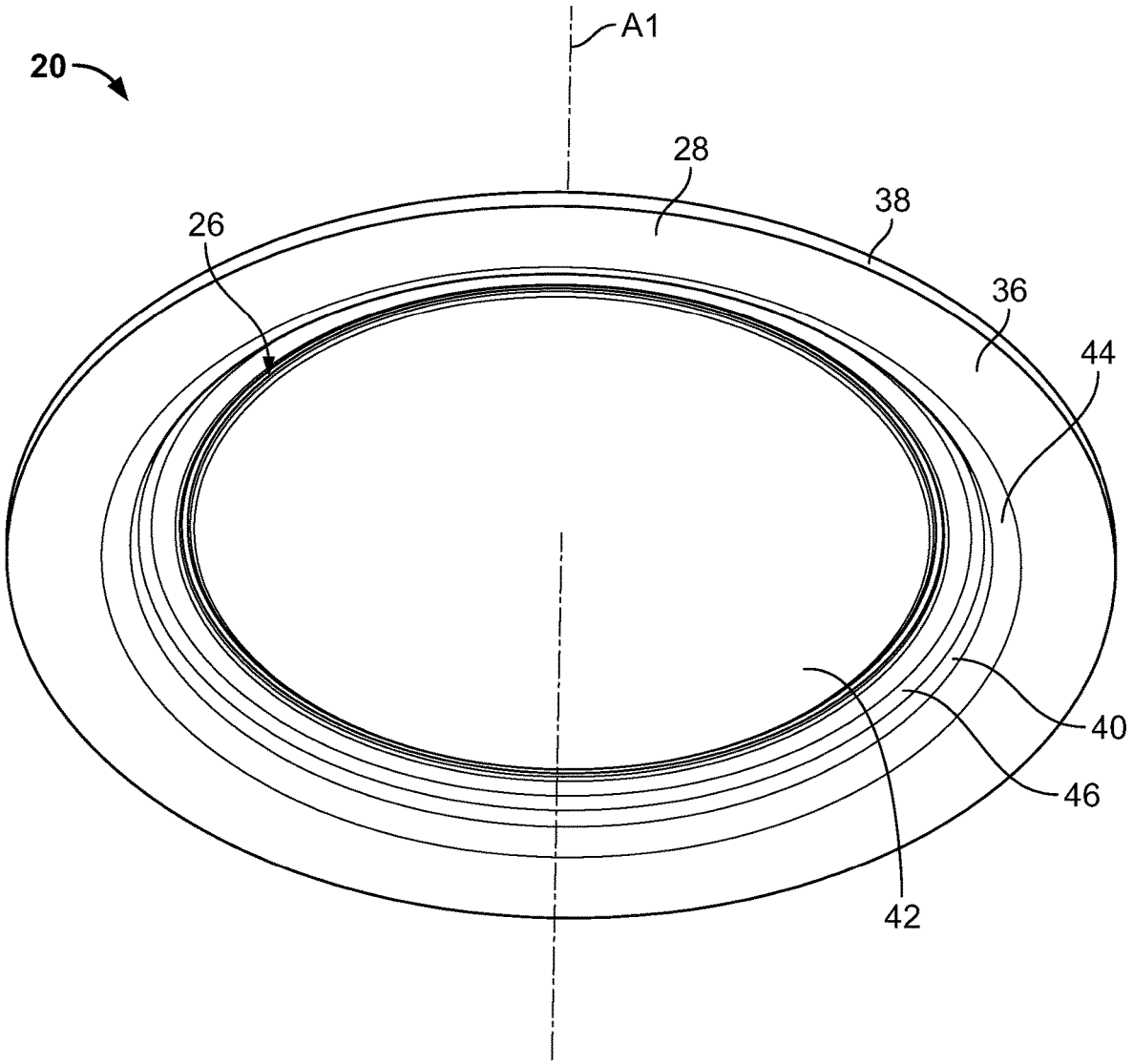
FIG. 2 is a bottom isometric view of the lid of FIG. 1.

FIGS. 1-7 illustrate a plate, lid, or closure 20 in accordance with the present disclosure. Referring specifically to FIGS. 1 and 2, top and bottom isometric views of the closure 20 are depicted, which highlight a first pressure relief feature 22 along a top side 24 of the closure 20, and a second pressure relief feature 26 along a bottom side 28 of the closure 20. While the closure 20 is described and shown in the various figures as having top and bottom sides 24, 28, it should be understood that the closure 20 may be disposed with either of its top side 24 and bottom side 28 in an upward-facing or downward-facing configuration, and need not be limited to the orientations depicted within the figures. The closure 20 disclosed herein may be adapted to be connected to a sidewall 30 of a canister or container 32 (see FIG. 7) by any conventional means, such as by a crimp, welding, a double seam connection, or another conventional method of attachment. The container 32 may include a material or materials contained therein that is/are pressurized before, during, or after attachment of the closure 20 to the container 32.

As will be described hereinafter below, the combination of the first and second pressure relief features 22, 26 along the closure 20 allow for controlled and targeted pressure relief when a maximum pressure threshold has been achieved. In cross section, and referring to FIGS. 4-6, the first pressure relief feature 22 is a first notch that defines a generally trapezoidal profile with curved or flared sides, while the second pressure relief feature 26 is a second notch that defines a generally trapezoidal profile with curved or flared sides. For ease of reference, the first pressure relief feature 22 will be referred to as the first notch 22, while the second pressure relief feature 26 will be referred to as the second notch 26. For purposes of this disclosure, the term "notch" refers to a pressure relief feature that is an inset region cutout or machined from the closure 20. While not specifically shown in the figures, in some embodiments, the second notch 26 may be disposed along both the top side 24 and the bottom side 28, or the first notch 22 may be disposed along both the top side 24 and the bottom side 28. The first and second pressure relief features 22, 26 may be cutouts that define one or more flat or planar surfaces. Alternatively, the first and second pressure relief features 22, 26 may be cutouts that define only curved surfaces.

Referring to FIG. 1, the closure 20 is generally disc-shaped and defines an outer wall 36 comprising an outer rim 38 that circumscribes a perimeter of the closure 20. The outer wall 36 joins an intermediate wall 40 that extends upward and inward from the outer wall 36 and intersects a base wall 42. The first notch 22 and the second notch 26 are each disposed along the base wall 42 (see FIG. 2). The walls 36, 40, 42 each define the top side 24 and the bottom side 28. The top side 24 of the walls 36, 40, 42 is generally contiguous, but is interrupted by the first notch 22. The bottom side 28 of the walls 36, 40, 42 is also generally contiguous, and is interrupted by the second notch 26. The outer wall 36 joins the intermediate wall 40 at a first corner 44, and the intermediate wall 40 joins the base wall 42 at a second corner 46. Each of the corners 44, 46 is generally rounded, and define portions of the top side 24 and the bottom side 28 of the closure 20.

As shown in FIGS. 1 and 2, the first notch 22 and the second notch 26 may extend 360.000 degrees about a first axis or longitudinal axis A1. The first axis A1 extends through the closure 20 and is orthogonal with respect to the base wall 42. In some embodiments, the first notch 22 and the second notch 26 may extend about only a portion of the first axis A1. In some embodiments, the first notch 22 and the second notch 26 may extend between about 10.000 degrees and about 350.000 degrees about the first axis A1, or between about 20.000 degrees and about 340.000 degrees about the first axis A1, or between about 30.000 degrees and about 330.000 degrees about the first axis A1, or between about 40.000 degrees and about 320.000 degrees about the first axis A1, or between about 50.000 degrees and about 310.000 degrees about the first axis A1, or between about 60.000 degrees and about 300.000 degrees about the first axis A1, or between about 70.000 degrees and about 290.000 degrees about the first axis A1, or between about 80.000 degrees and about 280.000 degrees about the first axis A1, or between about 90.000 degrees and about 270.000 degrees about the first axis A1, or between about 100.000 degrees and about 260.000 degrees about the first axis A1, or between about 110.000 degrees and about 250.000 degrees about the first axis A1, or between about 120.000 degrees and about 240.000 degrees about the first axis A1, or between about 130.000 degrees and about 230.000 degrees about the first axis A1, or between about 140.000 degrees and about 220.000 degrees about the first axis A1, or between about 150.000 degrees and about 210.000 degrees about the first axis A1, or between about 160.000 degrees and about 200.000 degrees about the first axis A1, or between about 170.000 degrees and about 190.000 degrees about the first axis A1.

In some embodiments, the first notch 22 and the second notch 26 may extend between 139.000 degrees and 360.000 degrees about the first axis A1, or between about 145.000 degrees and about 355.000 degrees about the first axis A1, or between about 150.000 degrees and about 350.000 degrees about the first axis A1, or between about 155.000 degrees and about 345.000 degrees about the first axis A1, or between about 160.000 degrees and about 340.000 degrees about the first axis A1, or between about 165.000 degrees and about 335.000 degrees about the first axis A1, or between about 170.000 degrees and about 330.000 degrees about the first axis A1, or between about 175.000 degrees and about 325.000 degrees about the first axis A1, or between about 180.000 degrees and about 320.000 degrees about the first axis A1, or between about 185.000 degrees and about 315.000 degrees about the first axis A1, or between about 190.000 degrees and about 310.000 degrees about the first axis A1, or between about 195.000 degrees and about 305.000 degrees about the first axis A1, or between about 200.000 degrees and about 300.000 degrees about the first axis A1, or between about 210.000 degrees and about 290.000 degrees about the first axis A1, or between about 220.000 degrees and about 280.000 degrees about the first axis A1, or between about 230.000 degrees and about 270.000 degrees about the first axis A1, or between about 240.000 degrees and about 260.000 degrees about the first axis A1.

In some embodiments, the first notch 22 and the second notch 26 may extend about 10.000 degrees, or about 20.000 degrees, or about 30.000 degrees, or about 40.000 degrees, or about 50.000 degrees, or about 60.000 degrees, or about 70.000 degrees, or about 80.000 degrees, or about 90.000 degrees, or about 100.000 degrees, or about 110.000 degrees, or about 120.000 degrees, or about 130.000 degrees, or about 140.000 degrees, or about 150.000 degrees, or about 160.000 degrees, or about 170.000 degrees, or about 180.000 degrees, or about 190.000 degrees, or about 200.000 degrees, or about 210.000 degrees, or about 220.000 degrees, or about 230.000 degrees, or about 240.000 degrees, or about 250.000 degrees, or about 260.000 degrees, or about 270.000 degrees, or about 280.000 degrees, or about 290.000 degrees, or about 300.000 degrees, or about 310.000 degrees, or about 320.000 degrees, or about 330.000 degrees, or about 340.000 degrees, or about 350.000 degrees, or about 360.000 degrees about the first axis A1.

The degree to which the first notch 22 and the second notch 26 extend about the first axis A1 may affect the performance and accuracy of the closure 20. For example, having the first notch 22 and the second notch 26 extend 170.000 degrees about the first axis A1 provides the closure 20 with improved accuracy to rupture at a particular or a maximum pressure inside the container 32 (see FIG. 6), as well as improved ventilation of materials through the closure 20.

Referring to FIGS. 1 and 2, the second notch 26 and the first notch 22 are shown disposed inside of the second corner 46 along the base wall 42. The second notch 26 and the first notch 22 may be spaced at any point inside the second corner 46 along the base wall 42. In some embodiments, the closure 20 may include a single planar or curved wall, and the first notch 22 and the second notch 26 may be disposed in a similar fashion about a first axis A1 that extends through a center point thereof In some embodiments, one or more of the corners 44, 46 may be removed, or one or more of the walls 36, 40, 42 may be removed. Alternatively, in some embodiments, one or more corners (not shown) may be added, or one or more walls (not shown) may be added. Still further, in some embodiments, the second notch 26 and the first notch 22 may disposed at another location along the closure 20, and need not be centered about an axis.

Still referring to FIGS. 1 and 2, the rim 38 that extends about the periphery of the closure 20 is shown. In some embodiments, the outer wall 36 may be adapted to be crimped or otherwise coupled to the container 32 (see FIG. 7). As noted above, the closure 20 may be fastened to the container 32 using one or more fastening means, such as crimping, welding, or a double seam connection. To that end, the outer wall 36 of the closure 20 may be manipulated, molded, or otherwise attached to another element to secure a material (not shown) within the container 32, whereby the material may become pressurized before, during, or after the closure 20 is secured to the container 32.

Figure 3:
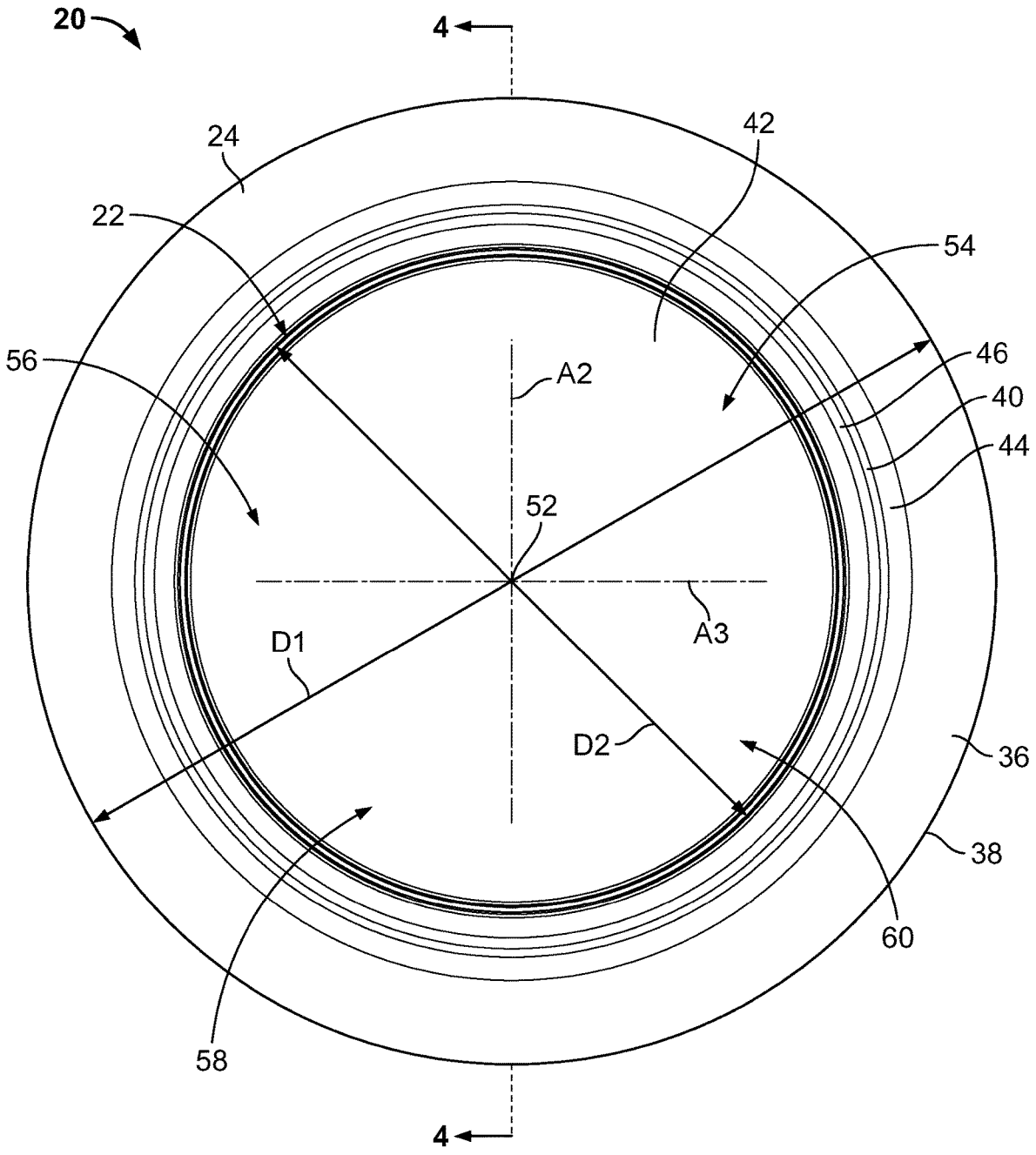
FIG. 3 is a top plan view of the lid of FIG. 1, illustrating the first pressure relief feature.

FIG. 3 is a top plan view of the lid of FIG. 1, illustrating the cutout 22 in greater detail. A second axis A2 and a third axis A3 intersect at a center point 52 of the closure 20 to separate the closure 20 into a first quadrant 54, a second quadrant 56, a third quadrant 58, and a fourth quadrant 60. In some embodiments, the first notch 22 may span only the first quadrant 54, or only the first and second quadrants 54, 56, or only the first, second, and third quadrants 54, 56, 58. In some embodiments, the first notch 22 may be closer to the center point 52 within the first quadrant 54 than within the second quadrant 56. In some embodiments, the first notch 22 may be closer to the center point 52 within the third quadrant 58 than within the first quadrant 54. In some embodiments, a third notch (not shown) may be disposed between the first notch 22 and the center point 52 within any one of the quadrants 54, 56, 58, 60.

As will be discussed with respect to the cross-sectional views below (see FIGS. 4-6), the second notch 26 is aligned with, and disposed directly opposing the first notch 22, according to the present disclosure. As a result, the description above with respect to the location of the cutout 22 and the four quadrants 54, 56, 58, 60 applies in a similar manner to the second notch 26. While the present closure 20 is in the shape of a circle, it is contemplated that the closure 20 may take other forms, and may be in the shape of an oval, a square, a rectangle, or a polygon. To that end, the closure 20 may be divided into alternative regions (not shown) of substantially the same area, in a similar fashion as the quadrants 54, 56, 58, 60 described herein, and the second notch 26 (see FIG. 2) and first notch 22 may be altered within these regions in a similar fashion as described above with respect to the quadrants 54, 56, 58, 60.

Still referring to FIG. 3, the closure 20 defines a first diameter D1. Further, the first notch 22 defines a second diameter D2 that extends through a center point of the closure 20. The first diameter D1 and the second diameter D2 may define a ratio of D2/D1 of between about 0.500 and about 0.990, or between about 0.550 and about 0.990, or between about 0.600 and about 0.990, or between about 0.650 and about 0.990, or between about 0.700 and about 0.990, or between about 0.750 and about 0.990, or between about 0.800 and about 0.990, or between about 0.850 and about 0.990, or between about 0.900 and about 0.990, or between about 0.950 and about 0.990. The ratio of D2/D1 may alternatively be between about 0.500 and about 0.990, or between about 0.600 and about 0.800, or about 0.750. The ratio of the second diameter to the first diameter may affect the performance and accuracy of the closure 20. For example, having a ratio of D2/D1 of about 0.750 provides the closure 20 with improved accuracy to rupture at a particular or a maximum pressure inside the container 32 (see FIG. 7).

Figure 4:
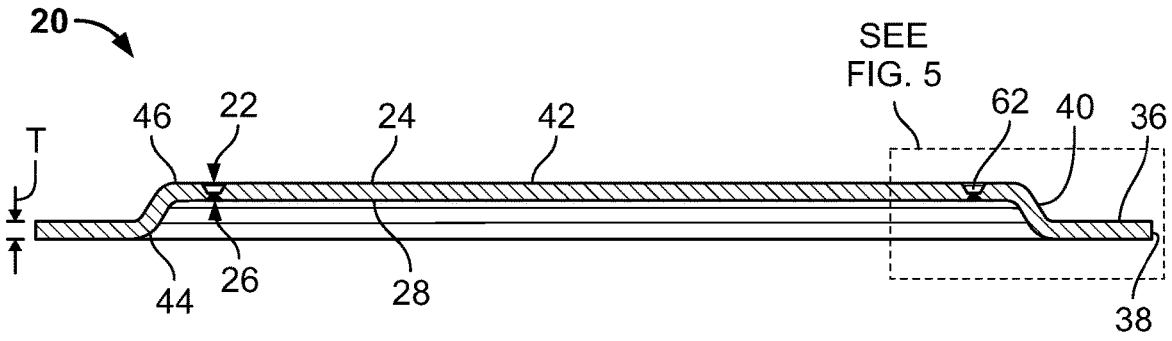
FIG. 4 is a side cross-sectional view taken through line 4-4 of FIG. 4.

Referring now to FIG. 4, a side cross-sectional view is illustrated that is taken through line 4-4 of FIG. 3. The top side 24 and the bottom side 28 of the closure 20 are shown being disposed above and below the various walls 36, 40, 42 that define the closure 20. The second notch 26 and the first notch 22 are depicted along opposing sides of the closure 20, and a membrane or rupture wall 62 is shown disposed between the first notch 22 and the second notch 26. As noted above, additional notches may be provided along the closure 20 in varying locations along one or more of the walls 36, 40, 42; however, for purposes of the present disclosure, only the second notch 26 and the first notch 22 will be discussed. The first notch 22 is disposed directly above the second notch 26 such that a line or fourth axis A4 drawn through both the first notch 22 and the second notch 26 centrally intersects each of these features.

Figure 5:
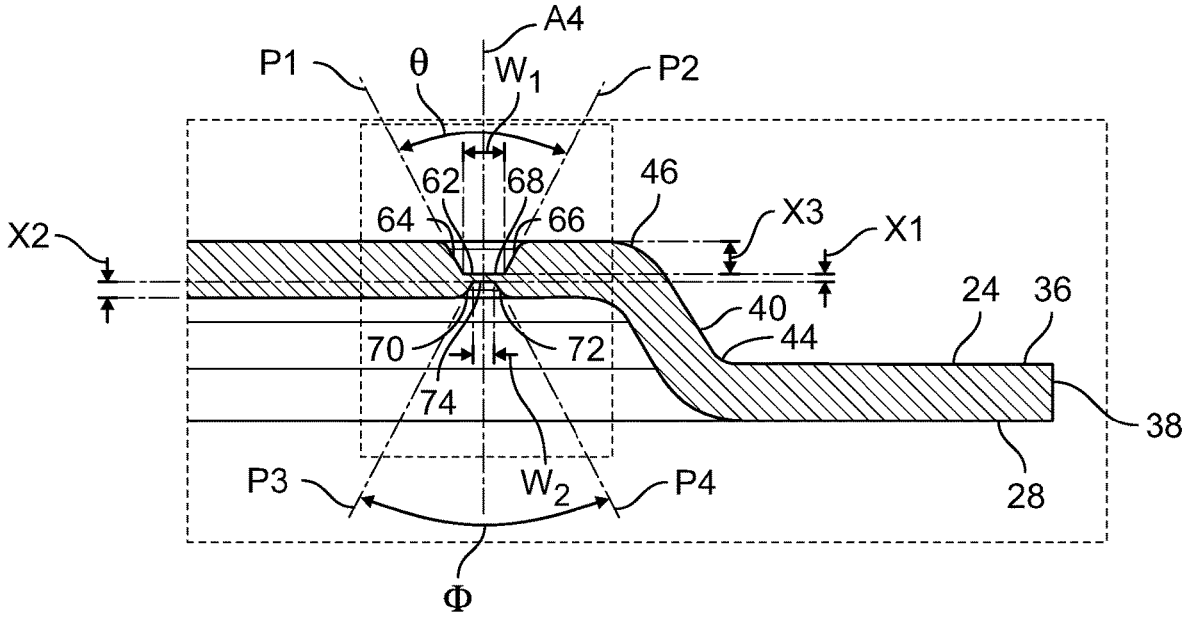
FIG. 5 is a detail view of a highlighted portion of FIG. 4.

Referring now to FIG. 5, which depicts a detail view of a portion of FIG. 4, the first notch 22 is defined by a first or top inner side surface 64 and a second or top outer side surface 66, which are connected to one another by a first planar surface 68. The first planar surface 68 is one of the surfaces that defines the membrane or rupture wall 62. The second notch 26 is disposed along the opposing side of the membrane 62. While the first surface 64 and the second surface 66 define curved portions that intersect with the top side 24, the first surface 64 and the second surface 66 comprise straight or planar portions that define a first plane P1 and a second plane P2, respectively, which pass over each of the first surface 64 and the second surface 66 to form a trapezoidal configuration. The first plane and the second plane intersect to form an angle θ of between about 60.000 degrees and about 90.000 degrees. In some embodiments, the first plane P1 and the second plane P2 may intersect to form an angle θ of between about 60.000 degrees and about 180.000 degrees, or between about 65.000 degrees and about 175.000 degrees, or between about 70.000 degrees and about 170.000 degrees, or between about 75.000 degrees and about 165.000 degrees, or between about 80.000 degrees and about 160.000 degrees. In some embodiments, the first plane P1 and the second plane P2 may intersect to form an angle θ of about 50.000 degrees, or about 55.000 degrees, or about 60.000 degrees, or about 65.000 degrees, or about 70.000 degrees, or about 75.000 degrees, or about 80.000 degrees, or about 85.000 degrees, or about 90.000 degrees, or about 95.000 degrees, or about 100.000 degrees, or about 105.000 degrees, or about 110.000 degrees, or about 115.000 degrees, or about 120.000 degrees, or about 125.000 degrees, or about 130.000 degrees, or about 135.000 degrees, or about 140.000 degrees, or about 145.000 degrees, or about 150.000 degrees, or about 155.000 degrees, or about 160.000 degrees, or about 165.000 degrees, or about 170.000 degrees, or about 175.000 degrees.

Still referring to FIG. 5, the second notch 26 is defined by a third or bottom inner side surface 70 and a fourth or bottom outer side surface 72, which are connected to one another by a second planar surface 74. The second planar surface 74 is one of the surfaces that defines the membrane or rupture wall 62. The first notch 22 is disposed along the opposing side of the membrane 62. While the third surface 70 and the fourth surface 72 define curved portions that intersect with the bottom side 28, the first surface 70 and the second surface 72 comprise straight or planar portions that define a third plane P3 and a fourth plane P4, respectively, which pass over each of the third surface 70 and the fourth surface 72 to form a trapezoidal configuration. The third plane and the fourth plane intersect to form an angle ϕ of between about 60.000 degrees and about 90.000 degrees. In some embodiments, the third plane P3 and the fourth plane P4 may intersect to form an angle ϕ of between about 60.000 degrees and about 180.000 degrees, or between about 65.000 degrees and about 175.000 degrees, or between about 70.000 degrees and about 170.000 degrees, or between about 75.000 degrees and about 165.000 degrees, or between about 80.000 degrees and about 160.000 degrees. In some embodiments, the third plane P3 and the fourth plane P4 may intersect to form an angle ϕ of about 50.000 degrees, or about 55.000 degrees, or about 60.000 degrees, or about 65.000 degrees, or about 70.000 degrees, or about 75.000 degrees, or about 80.000 degrees, or about 85.000 degrees, or about 90.000 degrees, or about 95.000 degrees, or about 100.000 degrees, or about 105.000 degrees, or about 110.000 degrees, or about 115.000 degrees, or about 120.000 degrees, or about 125.000 degrees, or about 130.000 degrees, or about 135.000 degrees, or about 140.000 degrees, or about 145.000 degrees, or about 150.000 degrees, or about 155.000 degrees, or about 160.000 degrees, or about 165.000 degrees, or about 170.000 degrees, or about 175.000 degrees.

Still referring to FIG. 5, a fourth axis A4 extends centrally through both the first notch 22 and the second notch 26. The fourth axis A4 extends centrally through both the first notch 22 and the second notch 26 about an entire extent of the first notch 22 and the second notch 26. Alignment of the first notch 22 and the second notch 26 is preferred to create a controlled system whereby a vent may be formed when the membrane 62 is ruptured after a maximum pressure has been achieved within the container 32.

Figure 6:
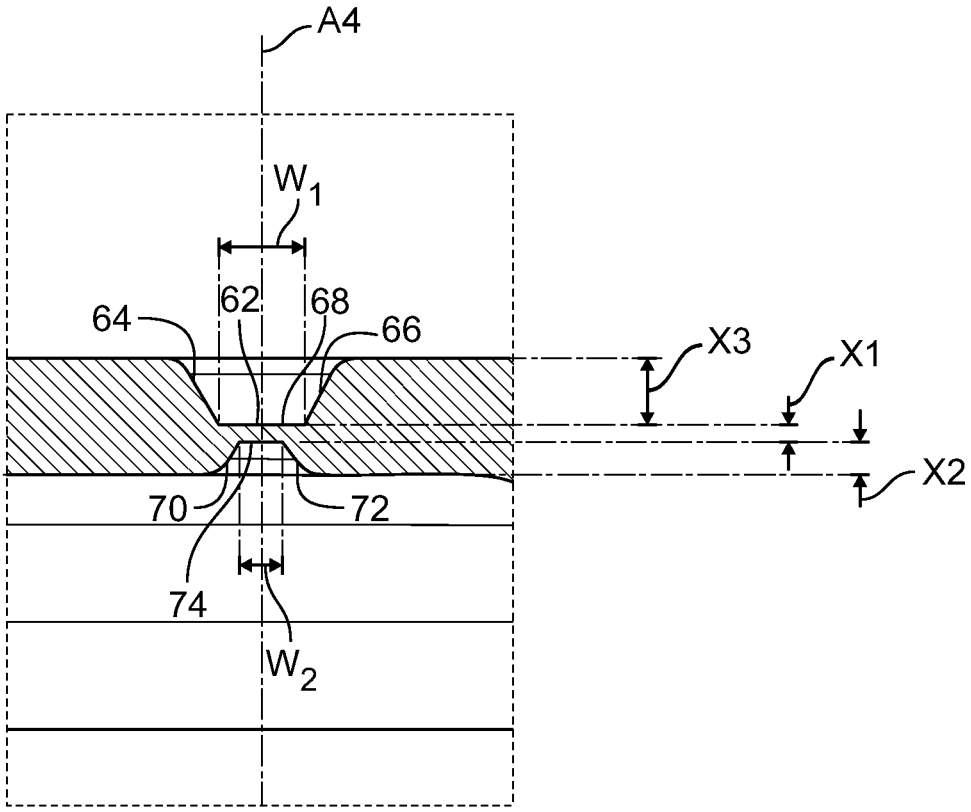
FIG. 6 is a partial enlarged view of a portion of FIG. 5.
Figure 7:
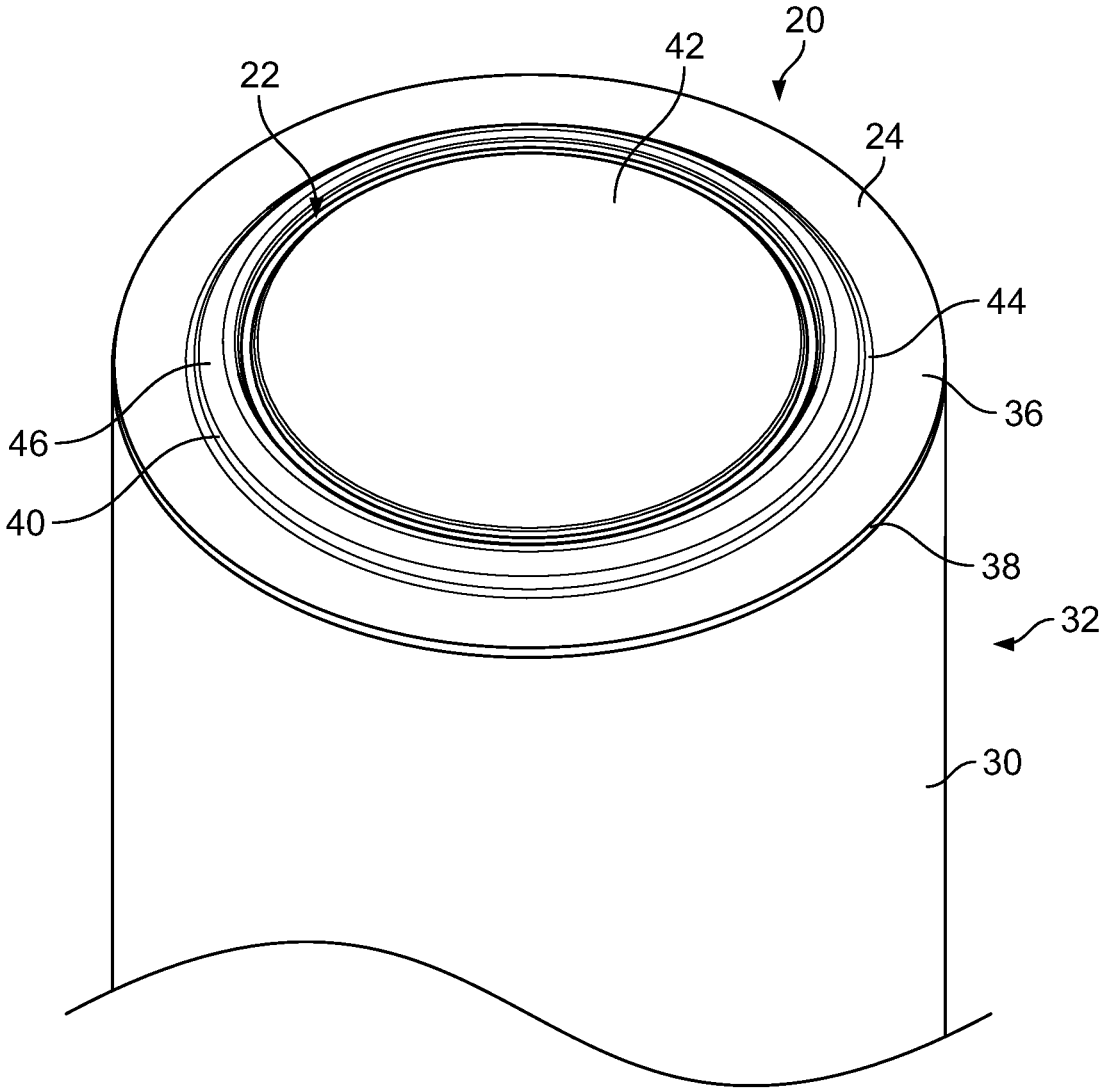
FIG. 7 is an isometric view of the lid of FIG. 1 applied to a container in a bottom-up orientation.

Referring now to FIG. 6, a partial enlarged view of a portion of FIG. 5 is illustrated. The first planar surface 68 defines a first width W1 that may be between about 0.005 mm and about 0.020 mm, or between about 0.010 mm and about 0.015 mm, or between about 0.100 mm and about 0.900 mm, or between about 0.200 mm and about 0.800 mm, or between about 0.300 mm and about 0.700 mm, or between 0.400 mm and about 0.600 mm, or about 0.500 mm, or about 0.012 mm. In a preferred embodiment, the first width W1 is about 0.510 mm. The second planar surface 74 defines a second width W2 that may be between about 0.050 mm and about 0.500 mm, or between about 0.100 mm and about 0.400 mm, or between about 0.180 mm and about 0.380 mm, or between 0.250 mm and about 0.300 mm. In a preferred embodiment, the second width W2 is about 0.280 mm.

The membrane 62 that is disposed between the second notch 26 and the first notch 22 is defined by a membrane thickness or distance X1, as shown in FIG. 5 and FIG. 6. The second notch 26 further defines a depth that is a distance X2, and the first notch 22 defines a depth that is a distance X3. The distances X1, X2, and X3 define a total thickness T of the closure 20 (see FIG. 4). In some embodiments, the distance X1 is between about 0.005 mm and about 0.012 mm, or between about 0.006 mm and about 0.010 mm, or between about 0.010 mm and about 0.200 mm, or between about 0.030 mm and about 0.170 mm, or between about 0.060 mm and about 0.140 mm, or about 0.100 mm, or about 0.008 mm. In some embodiments, the distance X2 is between about 0.010 mm and about 0.400 mm, or between about 0.050 mm and about 0.300 mm, or between about 0.015 mm and about 0.250 mm, or about 0.200 mm. In some embodiments, the distance X3 is between about 0.010 mm and about 0.600 mm, or between about 0.100 mm and about 0.500 mm, or between about 0.200 mm and about 0.450 mm, or about 0.400 mm. In some embodiments, the thickness T is between about 0.200 mm and about 1.000 mm, or between about 0.300 mm and about 0.900 mm, or between about 0.400 mm and about 0.800 mm, or about 0.700 mm.

The first and second venting features 22, 26, i.e., the first notch and the second notch, may be disposed along any opposing surfaces of a wall of a pressurized container. The second notch 26 is effectively a score within the closure 20, the depth of which may be modified depending on an internal pressure of the container 32 (see FIG. 7). The closure 20 may comprise a wide variety of metals including stainless steel, carbon steel, aluminum, hastelloy, nickel alloys, titanium, tin, or a polymer that is capable of retaining a pressurized material therein. In a preferred embodiment, the closure 20 comprises nickel plated cold rolled steel.

Figure 8:
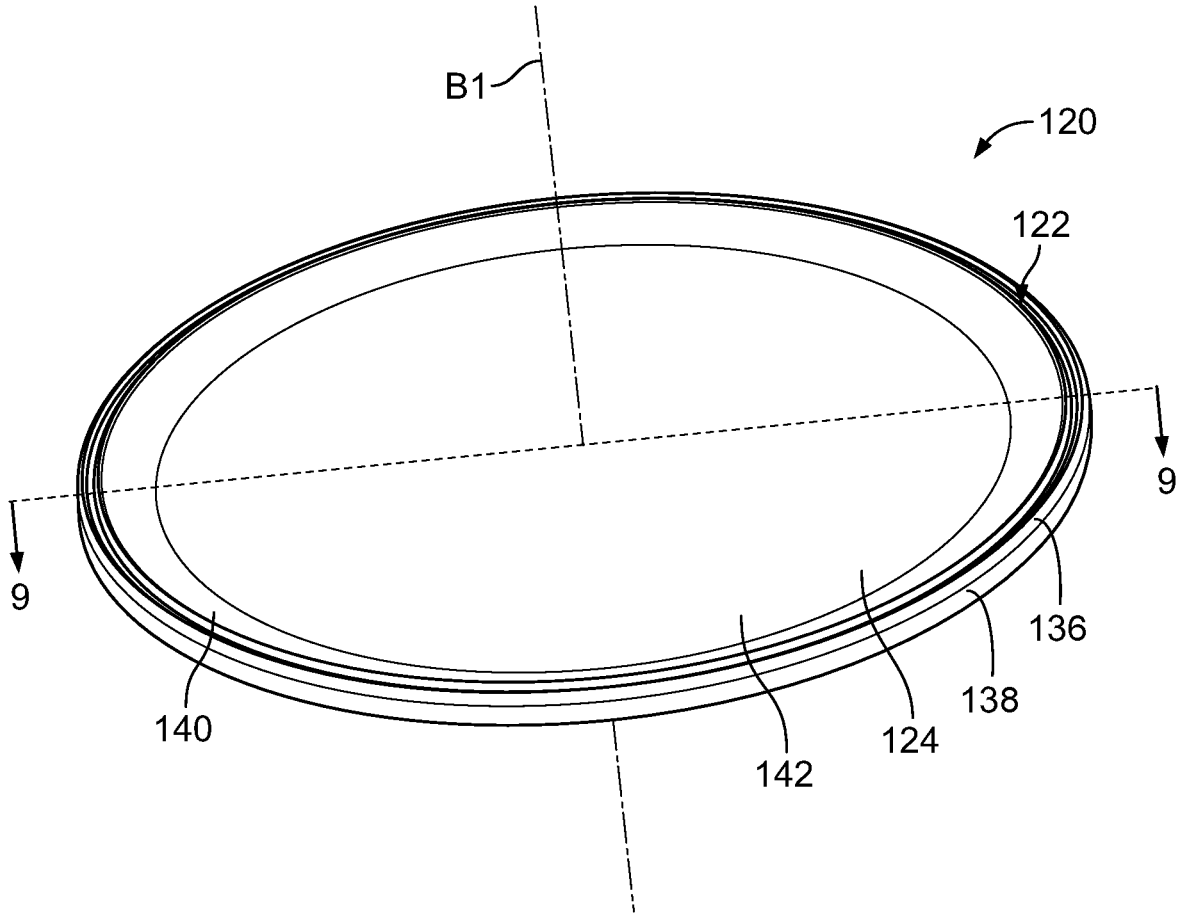
FIG. 8 is a top isometric view of a lid with a first pressure relief feature.
Figure 9:
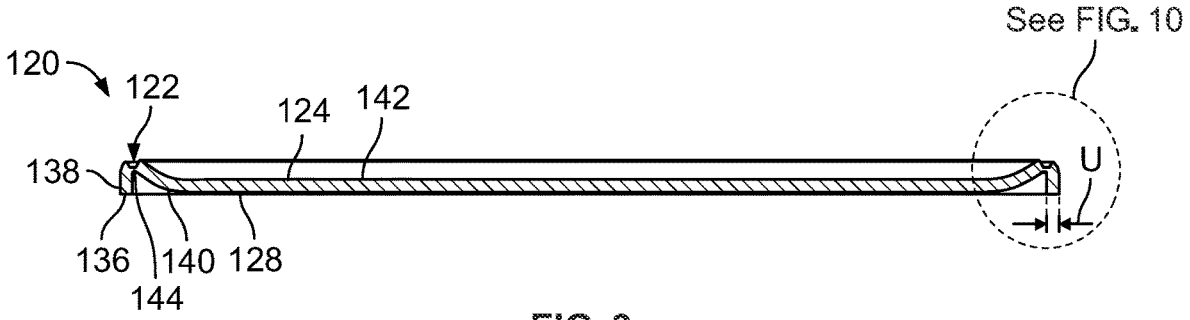
FIG. 9 is a side cross-sectional view taken through line 9-9 of FIG. 8.
Figure 10:
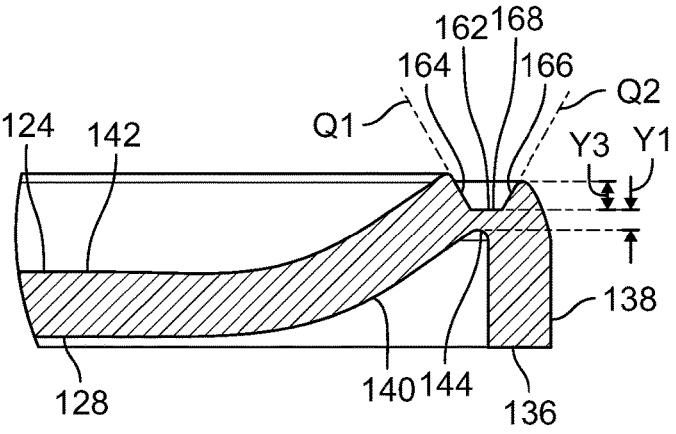
FIG. 10 is an enlarged detail view of a portion of FIG. 9.

FIGS. 8-10 illustrate another embodiment of a plate, lid, or closure 120 in accordance with the present disclosure. Referring specifically to FIG. 8, a top isometric view of the closure 120 is depicted, which highlights a first pressure relief feature 122 along a top side 124 of the closure 120. While the closure 120 is described and shown in the various figures as having top and bottom sides 124, 128, it should be understood that the closure 120 may be disposed with either of its top side 124 and bottom side 128 in an upward-facing or downward-facing configuration, and need not be limited to the orientations depicted within the figures. The closure 120 disclosed herein may be adapted to be connected to a sidewall 30 of a canister or container 32 (see FIG. 7) in a similar fashion as the closure 20 described above.

As will be described hereinafter below, the first pressure relief feature 122 along the closure 120 allows for controlled and targeted pressure relief when a maximum pressure threshold has been achieved within a container or canister to which the closure 120 has been applied. Referring to FIGS. 9 and 10, the first pressure relief feature 122 is a first notch that defines a generally trapezoidal profile with curved or flared sides. While not specifically shown in the figures, in some embodiments, the first notch 122 may be disposed along both the top side 124 and the bottom side 128 of the closure 120. The first pressure relief feature 122 may be a cutout that defines one or more flat or planar surfaces, in a similar fashion as the pressure relief features 22, 26 described above. Alternatively, the first pressure relief feature 122 may be a cutout that defines only curved surfaces.

Referring to FIGS. 8 and 9, the closure 120 is generally disc-shaped and defines an outer wall 136 comprising an outer rim 138 that circumscribes a perimeter of the closure 120. The outer wall 136 joins an intermediate wall 140 that extends downward and inward from the outer wall 136 and intersects a base wall 142. The first notch 122 is disposed between the outer wall 136 and the intermediate wall 140. The walls 136, 140, 142 each define the top side 124 and the bottom side 128. The top side 124 of the walls 136, 140, 142 is generally contiguous, but is interrupted by the first notch 122. The bottom side 128 of the walls 136, 140, 142 is generally contiguous, and is not interrupted by a notch. The outer wall 136 joins the intermediate wall 140 at a first corner 144. The corner 144 is generally rounded, and defines portions of the top side 124 and the bottom side 128 of the closure 120. The first corner 144 and the first notch 122 are depicted along opposing sides of the closure 120, and a membrane or rupture wall 162 (see FIG. 10) is shown disposed between the first notch 122 and the first corner 144.

As shown in FIG. 8, the first notch 122 may extend 360.000 degrees about a first axis or longitudinal axis B1. The first notch 122 may otherwise extend about the first axis B1 in a similar fashion as the first and second notches 22, 26 extend about the first axis A1, as described above. Further, the first notch 122 may be disposed along or cutout from the closure 120 in a similar fashion as described above with respect to the first notch 22 in the quadrants 54, 56, 58, 60.

Referring now to FIG. 10, the first notch 122 is defined by a first or top inner side surface 164 and a second or top outer side surface 166, which are connected to one another by a first planar surface 168. The first planar surface 168 is one of the surfaces that defines the membrane or rupture wall 162. The first corner 144 is disposed along the opposing side of the membrane 162. While the first surface 164 and the second surface 166 define curved portions that intersect with the top side 124, the first surface 164 and the second surface 166 comprise straight or planar portions that define a first plane Q1 and a second plane Q2, respectively, which pass over each of the first surface 164 and the second surface 166 to form a trapezoidal configuration. The first plane Q1 and the second plane Q2 may intersect in a similar fashion as planes P1 and P2 described above. Further, the first planar surface 168 may have similar or the same dimensions as the first planar surface 68 described above.

The membrane 162 that is disposed between the first notch 122 and the first corner 144 is defined by a membrane thickness or distance Y1, as shown in FIG. 10. Further, the first notch 122 defines a depth that is a distance Y3. The distances Y1 and Y3 may be defined in a similar fashion as the distances X1, X3 described above. Further, the distances Y1 and Y2 define a total thickness U of the closure 120 (see FIG. 9) that may be similar to the total thickness T of the closure 20 described above. The thickness U may be constant along the closure 120, or may vary along various portions thereof While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The claims are to be construed to include alternative embodiments to the extent permitted by the prior art.

It will be appreciated by those skilled in the art that while the embodiments of the present disclosure have been described in connection with particular embodiments and examples, the disclosure is not necessarily so limited, and that numerous other embodiments, examples, uses, modifications and departures from the embodiments, examples, and uses are intended to be encompassed by the claims attached hereto. Various features and advantages of the invention are set forth in the following claims.

We claim:

1. A closure for a pressurized container, comprising:

a plate with a top side and a bottom side;

a first notch that extends about a first axis along the top side; and a second notch that extends about the first axis along the bottom side, wherein the first and second notch form a membrane therebetween that is capable of being ruptured when a maximum pressure causes the membrane to rupture, wherein at a first location the first notch defines a first minimum width measured parallel to a second axis that extends perpendicular to the first axis and the second notch defines a second minimum width measured parallel to the second axis, wherein at a second location, disposed radially opposite the first location relative to the first axis, the first notch defines a third minimum width measured parallel to the second axis and the second notch defines a fourth minimum width measured parallel to the second axis, wherein the first minimum width is larger than the second minimum width, and the third minimum width is different than the fourth minimum width, wherein the first notch defines a first maximum depth measured parallel to the first axis and the second notch defines a second maximum depth measured parallel to the first axis, and wherein the first maximum depth is greater than the second maximum depth.

2. The closure of claim 1, wherein the first notch extends at least 140.000 degrees about the first axis.

3. The closure of claim 1, wherein the membrane defines a membrane thickness X1 of between about 0.010 mm and about 0.200 mm.

4. The closure of claim 3, wherein the first notch defines the first maximum depth that is a distance X2 and the second notch defines the second maximum depth that is a distance X3.

5. The closure of claim 4, wherein a sum of X1, X2, and X3 defines a total thickness of between about 0.200 mm and about 1.000 mm.

6. The closure of claim 1, wherein the plate is cold rolled steel.

7. The closure of claim 1, wherein a second axis extends centrally through the first notch and the second notch to align the first and second notch.

8. A closure for a pressurized container, comprising:

a plate with a top side and a bottom side, the top side defining a first diameter; p1 a first notch that extends about a first axis along the top side, the first notch defining an inner surface, an outer surface, and a bottom surface disposed between the inner surface and the outer surface, the inner surface being closer to the first axis than the outer surface, the first notch further defining a second diameter; and a second notch that extends about the first axis along the bottom side, wherein the inner surface defines a first plane that is tangent to a first point along the inner surface and the outer surface defines a second plane that is tangent to a second point along the outer surface, wherein a line between the first point and the second point is orthogonal with respect to the first axis, wherein the first plane and the second plane intersect to define a first angle of between 65.000 degrees and 180.000 degrees, wherein a ratio of the second diameter to the first diameter is between about 0.700 and about 0.990, wherein a first maximum depth of the first notch is greater than a second maximum depth of the second notch, and wherein a first minimum width of the first notch is greater than a second minimum width of the second notch.

9. The closure of claim 8, wherein the first angle is between about 70.000 degrees and about 175.000 degrees.

10. The closure of claim 8, wherein the bottom surface defines a bottom width of between about 0.200 mm and about 0.800 mm.

11. The closure of claim 8, wherein the first notch extends at least about 180.000 degrees about the first axis.

12. The closure of claim 8, wherein a second axis extends centrally through the first notch and the second notch to align the first and second notch.

13. A closure for a pressurized container, comprising:

a plate defining a top side, a bottom side, and a first diameter across the top side;

a first notch that extends about a first axis along the top side, the first notch defining a second diameter; and a second notch that extends about the first axis along the bottom side, wherein a ratio of the second diameter to the first diameter is between 0.700 and about 0.990, wherein the first notch defines a first minimum width measured parallel to a second axis that extends perpendicular to the first axis and the second notch defines a second minimum width measured parallel to the second axis, wherein the first minimum width is larger than the second minimum width, wherein the first notch defines a first maximum depth measured parallel to the first axis and the second notch defines a second maximum depth measured parallel to the first axis, and wherein the first maximum depth is greater than the second maximum depth.

14. The closure of claim 13, wherein the ratio of the second diameter to the first diameter is between about 0.750 and about 0.990.

15. The closure of claim 13, wherein the ratio of the second diameter to the first diameter is between about 0.800 and about 0.990.

16. The closure of claim 13, wherein a second axis extends centrally through the first notch and the second notch to align the first and second notch.

17. The closure of claim 13, wherein the first and second notch form a membrane that is capable of being ruptured when a maximum pressure causes the membrane to rupture.

18. The closure of claim 17, wherein the membrane defines a membrane thickness X1 of between about 0.010 mm and about 0.200 mm.

19. The closure of claim 2, wherein the first notch extends 360 degrees about the first axis.

* * * * *